United States Patent [19]

Grabowski et al.

[11] Patent Number: 4,692,106

[45] Date of Patent: Sep. 8, 1987

[54] APPARATUS FOR STRETCHING THE INDIVIDUAL STRANDS OF A BUNDLE OF FIBERS OR THREADS

[75] Inventors: Robert Grabowski, Troisdorf; Walter Krämer, Bonn, both of Fed. Rep. of Germany

[73] Assignee: Reifenhauser GmbH & Co. Maschinenfabrik, Troisdorf, Fed. Rep. of Germany

[21] Appl. No.: 824,622

[22] Filed: Jan. 31, 1986

[30] Foreign Application Priority Data

Feb. 5, 1985 [DE] Fed. Rep. of Germany ..... 3503818

[51] Int. Cl.[4] ..... D01D 5/12

[52] U.S. Cl. ..... 425/66; 264/211.14; 425/72 S; 425/140

[58] Field of Search ..... 28/240, 241; 264/176 F, 264/210.8, 237, 290.5, DIG. 73, 177.17, 177.19, 211.14, 211.17; 425/66, 72 R, 72 S, 140, 141, 464

[56] References Cited

U.S. PATENT DOCUMENTS

| | | | |
|---|---|---|---|
| 3,684,416 | 8/1972 | Lenk | 425/72 S |
| 3,706,826 | 12/1972 | Bremner et al. | 425/72 S |
| 3,707,593 | 12/1972 | Fukada et al. | 425/72 S |
| 3,787,195 | 1/1974 | Kirchheim | 264/176 F |
| 3,795,367 | 3/1974 | Mocarski | 264/176 F |
| 4,340,563 | 7/1982 | Appel et al. | 425/72 S |

FOREIGN PATENT DOCUMENTS

| | | | |
|---|---|---|---|
| 47-31363 | 8/1972 | Japan | 425/72 S |
| 60-151356 | 8/1985 | Japan | 425/72 R |
| 492600 | 1/1976 | U.S.S.R. | 425/72 S |

*Primary Examiner*—Jay H. Woo
*Assistant Examiner*—J. Fortenberry
*Attorney, Agent, or Firm*—Karl F. Ross; Herbert Dubno

[57] ABSTRACT

The stretching machine comprises a spinning bar, a blowing compartment, and a stretching chamber. The spinning bar has a plurality of spinning nozzles, from which the individual fibers are put out or extruded in a thermoplastic condition. The blowing compartment is provided with blowing nozzles or orifices through which air is introduced as a cooling as well as stretching means. The stretching chamber has stretching chamber walls which can form an accelerating constriction having a venturi nozzle like shape as seen in vertical cross section. The stretching chamber walls comprise a deformable material, which permits a deformation of the stretching chamber walls during operation. A plurality of adjusting mechanisms for adjusting the shape of the stretching chamber walls are connected to and distributed at various heights over the stretching chamber walls.

7 Claims, 4 Drawing Figures

APPARATUS FOR STRETCHING THE INDIVIDUAL STRANDS OF A BUNDLE OF FIBERS OR THREADS

FIELD OF THE INVENTION

Our present invention is related to an apparatus for stretching thermoplastic monofilaments of a bundle of chemically generated (synthetic) fibers, in which the operating conditions can be controlled and varied depending on the material which is used for the monofilament and the degree of stretching desired.

BACKGROUND OF THE INVENTION

Monofilament produced by extruding thermoplastic from the nozzles of a spinning bar is usually stretched to improve the properties and decrease the fineness of the filamenting product. The spun monofilament passes through a blowing compartment, and a stretching chamber.

The spinning bar has a plurality of spinning orifices, from which the individual fibers emerge in a plastic state.

The blowing chamber is provided with blowing orifices through which air is fed as a cooling and stretching means.

The stretching chamber has stretching chamber walls with an accelerating constriction having a venturi nozzle-shape as seen in vertical cross section. The apparatus is generally transverse to the direction of flow of air and of the monofilament. In the scope of this invention, however, it is also possible for the stretching chamber cross section to be round, for example, generally circular.

In the known air flow stretching apparatus the stretching chamber walls comprise comparatively thick panels or sheets. They are not deformable when mounted in the completely assembled device. The venturi nozzle accelerating constriction is constructed with predetermined shape, and cannot be altered during operation.

When on account of the material which is used for the fibers or threads, on account of the particular degree of stretching desired, or for other reasons an alternative shape of the venturi like accelerating constriction of the stretching chamber walls is required, a new stretching chamber must be constructed, and substituted for the stretching chamber currently in the apparatus.

In operation, the cross section also cannot be changed for the purpose of correction or optimization of the stretching or spinning process. In the known stretching machines, the only variable operation parameters are the air flow rate and velocity. Unfortunately, completely satisfactory results cannot be obtained by controlling these parameters alone.

OBJECTS OF THE INVENTION

It is an object of our invention to provide an improved stretching apparatus for stretching a bundle of monofilaments which avoids prior art drawbacks.

It is also an object of our invention to provide an improved stretching apparatus for stretching a bundle of monofilaments in which the stretching chamber has deformable stretching chamber walls, which can be controllably deformed during operation to optimize the stretching apparatus performance.

It is yet another object of our invention to provide an improved stretching apparatus for stretching a bundle of monofilaments, in which the venturi nozzle constriction of the stretching apparatus walls is constructed so that its shape can be changed during operation for adjustment of the stretching apparatus to different degrees of stretching and different fiber material parameters.

SUMMARY OF THE INVENTION

These objects and others, which will become more readily apparent hereinafter, are attained in accordance with our invention in a stretching apparatus for stretching a bundle of monofilaments, comprising a spinning bar or beam, a blowing compartment and a stretching chamber. The spinning bar has a plurality of spinning orifices from which the individual monofilaments are extruded in a thermoplastic condition, the blowing compartment is provided with a plurality of blowing orifices or nozzles through which air is introduced as a cooling or stretching means, and the stretching chamber has stretching chamber walls which have an accelerating constriction with a venturi nozzle shape as seen in vertical cross section.

According to our invention, the stretching chamber walls comprise a deformable material, which allows a deformation of the shape of the stretching chamber walls during operation of the stretching chamber, and a plurality of adjusting mechanisms for adjusting the shape of the stretching chamber walls are connected to and distributed at various heights and positions over the stretching chamber walls.

The stretching chamber walls can be constructed from an elastic, flexible, deformable material, such as rubber or plastic. Alternatively, the stretching chamber walls can be constructed from a plastically deformable material, when the adjusting mechanisms are so arranged that a venturi nozzle is formed by the stretching chamber walls during operation. The adjusting mechanisms can be motorized adjusting drives according to another especially desirable feature of our invention the motorized adjusting drives are connected to a computer, and the shape of the stretching chamber wall is charged by using the computer to control the motorized adjusting elements. In this way the shape of the walls can be automatically changed according to the parameters of the monofilament and the degree of stretching desired.

The principal advantage of our apparatus for spinning and stretching fibers is that during operation the shape of the venturi nozzle accelerating constriction can be adjusted for different operating conditions. This is achieved in a simple, easy way by suitable operation of the adjusting mechanisms. By the use of the adjusting mechanisms one easily can optimize the process in regard to the stretching and spinning steps and, of course, also with respect to the different material parameters, degrees of stretching, and so forth.

BRIEF DESCRIPTION OF THE DRAWING

The above and other objects, features, and advantages of our invention will become more readily apparent from the following description, reference being made to the highly diagrammatic drawing, in which.

SPECIFIC DESCRIPTION

Figure 1:
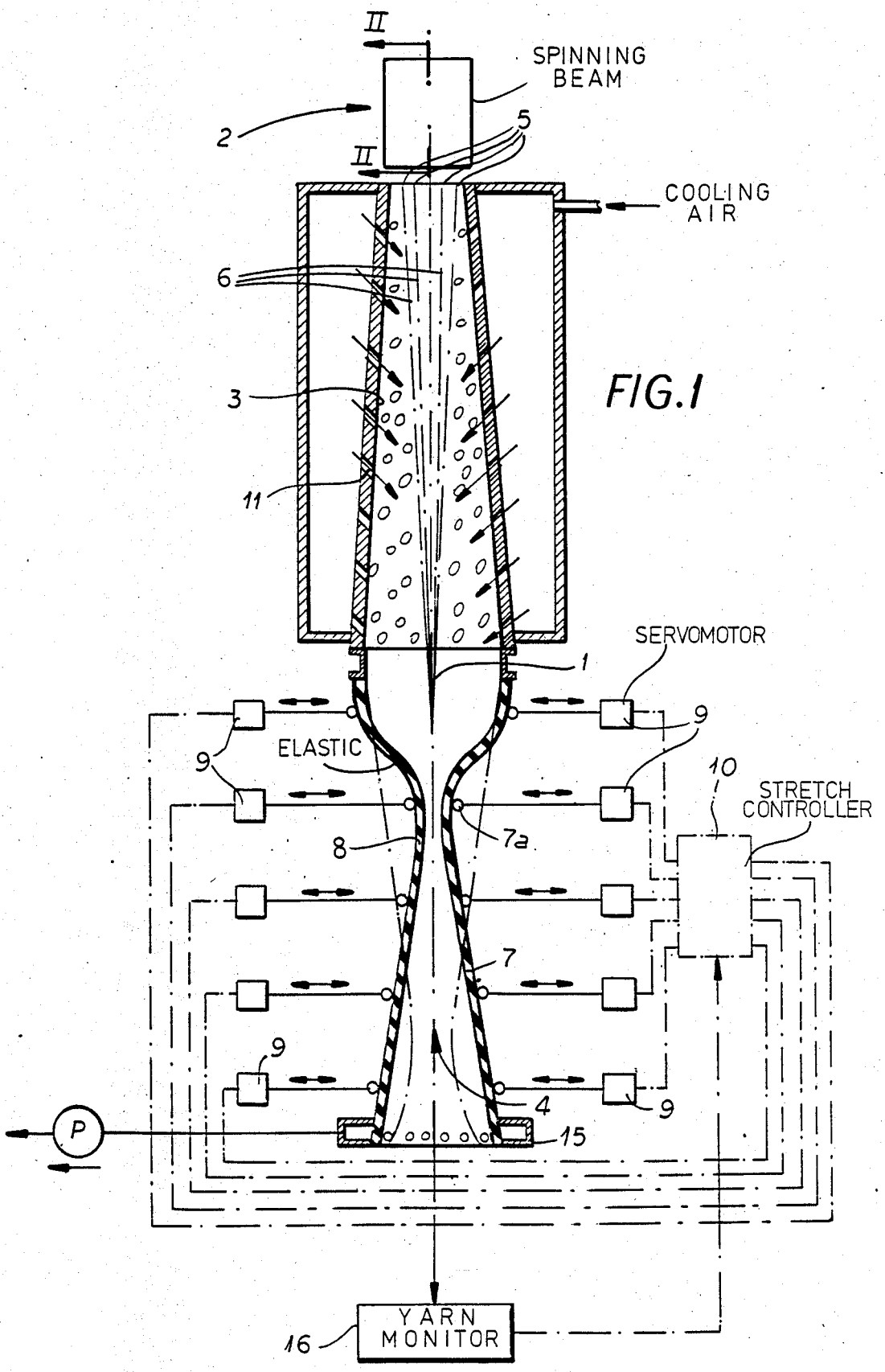
FIG. 1 is a vertical cross sectional view through a preferred embodiment of the stretching machine of our invention.
Figure 2:
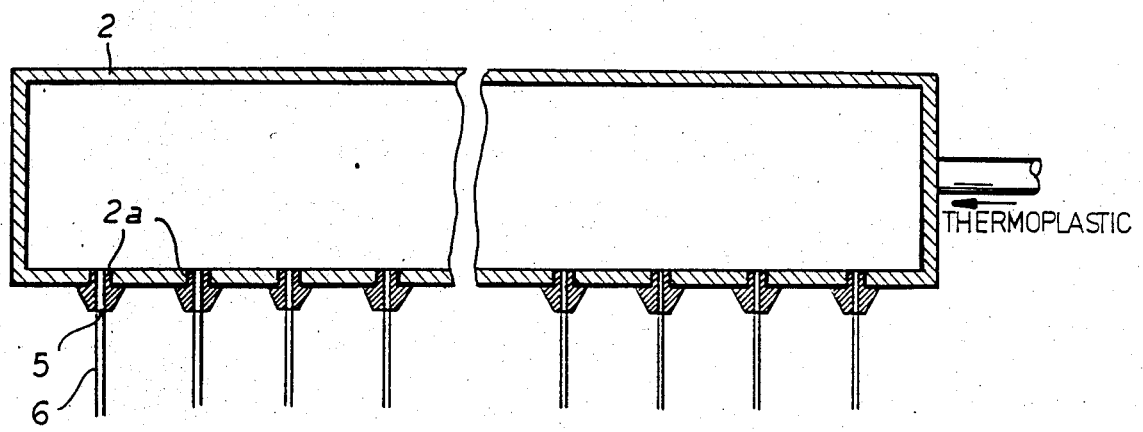
FIG. 2 is a section through the spinning bar of FIG. 1 along line II—II thereof.

The stretching apparatus shown in the drawing serves to stretch the monofilament 6 of the bundle 1.

As generally expressed, the apparatus stretches the spun chemical fibers 6.

Our stretching apparatus comprises a spinning bar 2, a blowing compartment 3, and a stretching chamber 4 in the example provided connected to and following the blowing compartment 3.

The spinning bar 2 has a plurality of spinning orifices 5 formed in nozzles *2a*, from which the individual monofilaments 6 emerge in a plastic condition.

The blowing compartment 3 is provided with blowing orifices or nozzles 11 for introduction of stretching air serving simultaneously as a cooling means and a stretching means.

The stretching chamber 4 has stretching chamber walls 7 which form an accelerating constriction 8 having a venturi nozzle shape as seen in the vertical cross section of FIG. 1. It is understood, that a low pressure source 15 is connected to the stretching chamber 4 at its bottom.

The stretching chamber walls 7 comprise a deformable material namely, rubber in the embodiment shown, which allows a venturi nozzle shaped deformation of the stretching chamber walls 7 during operation. Moreover, a plurality of adjusting mechanisms 9 for setting a predetermined shaped of the deformable stretching chamber walls 7 are distributed along the height of these walls 7 and connected to them at respective eyes *7a*. It is understood that the stretching chamber 4 and the apparatus is of rectangular cross section in a plane perpendicular to the plane of FIG. 1 and the direction of movement of this monofilament (downwardly) and that mechanisms 9 are spaced apart perpendicular to the plane of the paper.

Of course, the thickness of the material is chosen so that disturbing edges, kinks, or bends do not appear.

Figure 3:
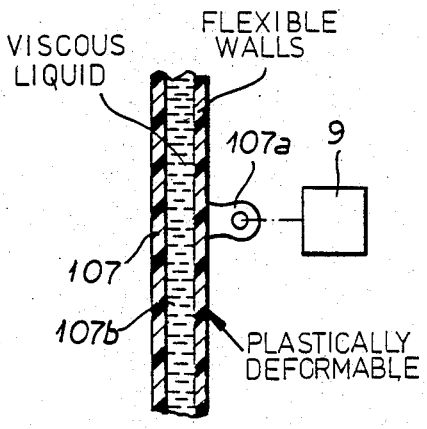
FIG. 3 is a section through a wall of a plastically deformable stretching chamber.

As can be seen from FIG. 3 the stretching chamber side walls 107 can also comprise a plastic deformable material e.g., a pair of foils of flexible plastic receiving a viscous liquid 107*b*. The adjusting mechanisms 9 anchored pivotally to the eyes *7a*, 107*a*, 207*a* are constructed as motorized drives. The dot-dash lines indicate that the adjusting mechanisms 9 are connected to a computer 10 and that the motorized adjusting drives 9 are controllable by this computer 10 according to the strand material parameters and the degree of stretching desired. It is understood that also the quantity of air blown and/or the low pressure source can be controlled. A monitor 16 responsive to monofilament diameter can provide an actual valve input to the stretch controller.

In the drawing, a possible shape for the stretching chamber walls in the form of a venturi nozzle accelerating constriction 8 is shown in solid lines. An alternative possible shape is shown with heavy dot-dash lines. A plurality of other intermediate and alternative shapes may be set by the adjusting mechanisms 9 as required.

Figure 4:
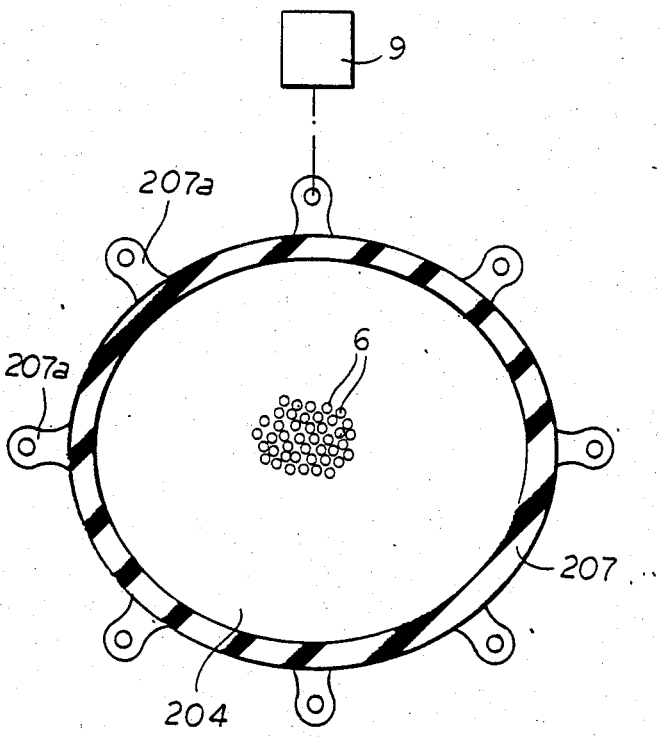
FIG. 4 is a horizontal section through another embodiment.

As seen in FIG. 4, a flexible wall stretching chamber 204, can also be enclosed in a round wall 207 which can be formed with the venturi constriction variably as previously described.

We claim:

1. An apparatus for spinning and stretching a multiplicity of monofilaments, comprising:

a spinning bar formed with a plurality of spinning orifices from which individual monofilaments emerge;

means adjacent said spinning bar forming an elongated blowing compartment receiving said individual monofilaments, said blowing compartment being formed with a plurality of blowing nozzles training jets of stretching and cooling air upon said monofilaments, said blowing compartment having an outlet at which said monofilaments and an air stream formed in said compartment emerge;

flexible wall means forming an elongated stretching chamber connected to said outlet and completely and directly surrounding a bundle formed by all of the monofilaments traversing said stretching chamber, said stretching chamber having the configuration of a venturi nozzle having an annular converging portion proximal to said outlet merging continuously and smoothly into an annular constriction and then continuously and smoothly into an annular diverging portion in a direction of movement of said bundle and said air stream through said stretching chamber;

a multiplicity of motor-driven adjusting mechanisms, each including a control motor, positioned along said flexible wall means and spaced apart in said direction for varying the shape of said venturi nozzle; and control means connected with said motors for selectively operating same to select said shape.

2. The apparatus defined in claim 1 wherein said flexible wall means is composed of an elastically deformable flexible material.

3. The apparatus defined in claim 2 wherein said material is rubber.

4. The apparatus defined in claim 1 wherein said flexible wall means is composed of a nonelastic deformable material.

5. The apparatus defined in claim 4 wherein said nonelastic deformable material is a plastic.

6. The apparatus defined in claim 1 wherein said control means includes a computer for changing said shape in accordance with material parameters of said strands and a degree of stretchability of said monofilaments.

7. The apparatus defined in claim 1 wherein said stretching chamber has an outlet end formed with apertures connected to a vacuum source.

* * * * *